US007131675B1

(12) United States Patent
Loucks

(10) Patent No.: US 7,131,675 B1
(45) Date of Patent: Nov. 7, 2006

(54) CAMP FIRE TOOL

(76) Inventor: Mark A. Loucks, 3441 Haleh Cir., Apartment D, Grand Rapids, MI (US) 49546

( * ) Notice: Subject to any disclaimer, the term of this patent is extended or adjusted under 35 U.S.C. 154(b) by 0 days.

(21) Appl. No.: 11/165,402

(22) Filed: Jun. 23, 2005

(51) Int. Cl.
*F24B 15/00* (2006.01)

(52) U.S. Cl. ..... 294/10; 294/14; 294/26; 7/109

(58) Field of Classification Search ..... 294/9, 294/10, 11, 12, 14, 24, 26, 61; 7/109, 164, 7/166
See application file for complete search history.

(56) References Cited

U.S. PATENT DOCUMENTS 481,763 A * 8/1892 Johnson ..... 140/102.5
2,126,201 A * 8/1938 McCall ..... 16/434
2,541,158 A * 2/1951 Gardiner ..... 294/12
3,618,147 A * 11/1971 Gaskill ..... 7/106
3,912,316 A * 10/1975 Veech ..... 294/1.4
4,004,539 A * 1/1977 Wesson ..... 114/221 R
4,037,554 A * 7/1977 Foscolo ..... 114/221 R
4,622,707 A * 11/1986 Finn ..... 7/158
4,815,997 A * 3/1989 Forsmark et al. ..... 441/82
5,425,562 A * 6/1995 Baldwin ..... 294/26
5,486,027 A * 1/1996 Dionne et al. ..... 294/51
D395,808 S 7/1998 Loucks
6,240,642 B1 * 6/2001 Templeton ..... 30/125

* cited by examiner

*Primary Examiner*—Dean J. Kramer

(57) ABSTRACT

A tool to be used for controlling campfires. This tool is has a bright or reflective mainshaft to place users on notice of its location, and its potentially dangerous temperature. This tool has a hook portion to accommodate standard sizes of camp fire wood for the control thereof. This tool also has a straight arm that extends beyond the hook portion to control the fire while poking at it, with no interference from the hook portion. The handle also has a directional compass. Further, a thermal barrier collar may be disposed adjacent the mainshaft or handle.

12 Claims, 2 Drawing Sheets

CAMP FIRE TOOL

BACKGROUND OF THE INVENTION

This invention relates to a camp fire tool, particularly to a camp fire tool used to manipulate burning embers while the user is located at a safe distance away from the camp fire.

U.S. Pat. No. D395,808 is a design patent by the present inventor, and discloses the general shape of the middle of the shaft. However it does not teach or suggest the new and novel functional features of the present invention described below.

As can be seen, there is a need for a camp fire stake tool that has a main shaft made of a material composite of having a metal portion for contacting the fire, and a handle or thermal barrier collar to receive the handle. The handle having grips for the fingers and a separate thumb recess to the thumb of the user can assist in controlling the invention. A compass is disposed at the front of the handle. A distal portion of the main shaft has a radius for handling cut firewood, the radius having a tangential linear finger, a small shaft parallel with the main shaft.

SUMMARY OF THE INVENTION

One aspect of the present invention is a main shaft having a proximal end, a middle portion, and a distal end; a handle disposed at said proximal end, said main shaft secured within said handle, said handle having finger grips, and an opposed thumb recess, said handle having a directional compass disposed at an end opposed from said main shaft, said handle further having a hanging aperture therethrough; a hook portion disposed at said distal end, said hook portion having a radius, and a further extending linear finger; and a straight arm disposed at said distal end, said straight end oriented substantially parallel to said main shaft.

Another aspect of the present invention is a camp fire tool comprising a main shaft having a proximal end, a middle portion, and a distal end; a handle disposed at said proximal end, said main shaft secured within said handle, said handle having finger grips, and an opposed thumb recess, said handle having a directional compass disposed at an end opposed from said main shaft, said handle further having a hanging aperture therethrough; a thermal barrier collar disposed axially between said handle and said mainshaft, said thermal barrier collar substantially concentric with said handle, secured to an outside diameter of said handle; a hook portion disposed at said distal end, said hook portion having a radius, and a further extending linear finger; and a straight arm disposed at said distal end, said straight end oriented substantially parallel to said main shaft.

Yet another aspect of the invention is a camp fire tool, comprising a main shaft having a proximal end, a middle portion, and a distal end; a thermal barrier collar disposed at said proximal end, said main shaft secured within said thermal barrier collar, said thermal barrier collar substantially concentric with said handle; a handle secured to said thermal barrier collar, said handle extending away from said mainshaft, said handle having finger grips, and an opposed thumb recess, said handle having a directional compass disposed at an end opposed from said main shaft, said handle further having a hanging aperture therethrough; a hook portion disposed at said distal end, said hook portion having a radius, and a further extending linear finger; and a straight arm disposed at said distal end, said straight end oriented substantially parallel to said main shaft.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
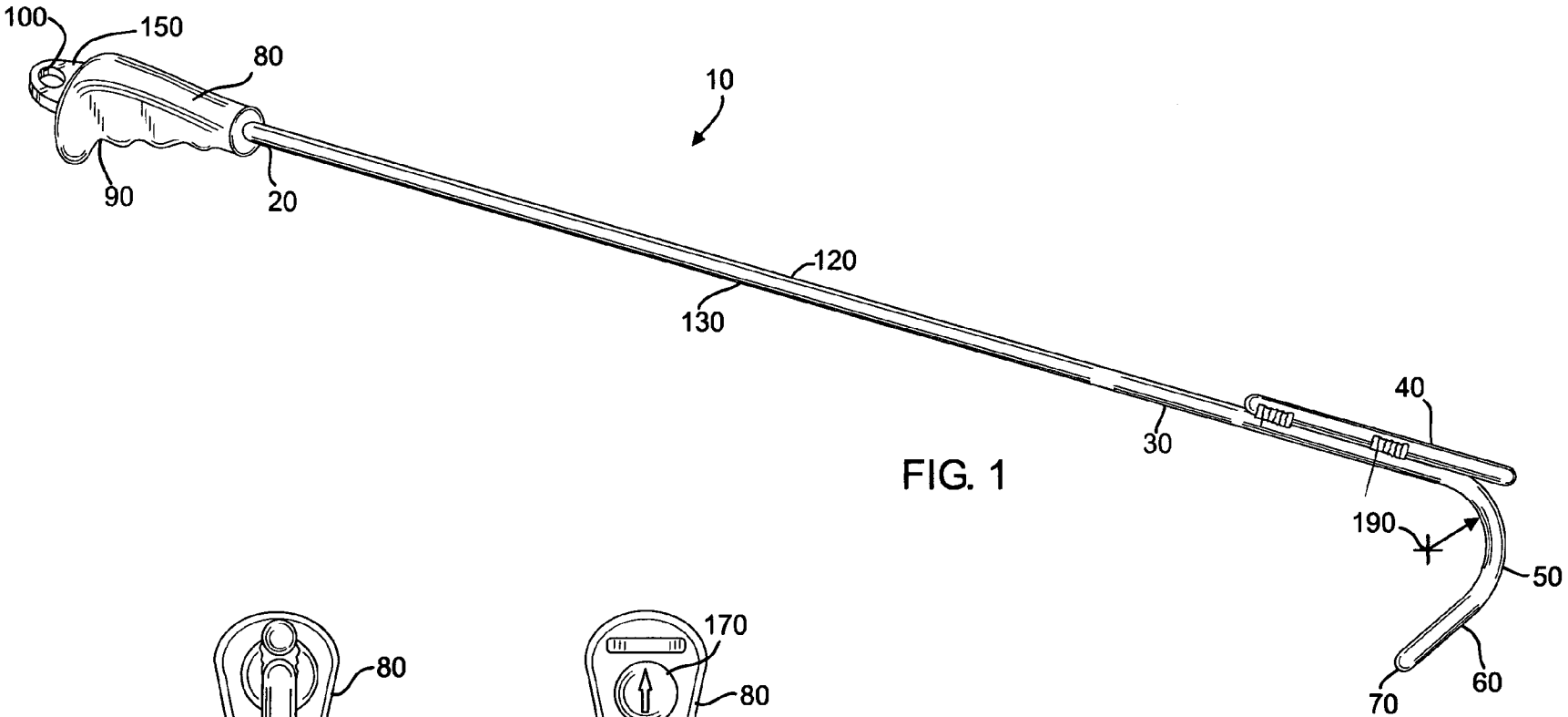
FIG. 1 is a pictorial of the present invention.
Figure 6:
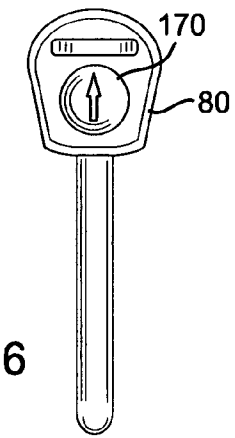
FIG. 6 is a rear view of the present invention.
Figure 5:
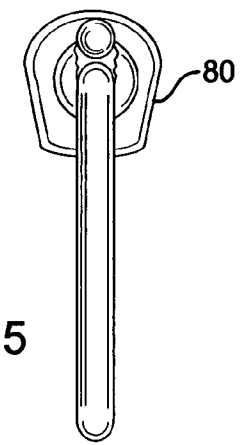
FIG. 5 is a front view of the present invention.

FIG. 1 illustrates one exemplary embodiment of the tool 10 having a main shaft 130 having a middle portion 120, a proximal end 20 and a distal end 30. The proximal end 20 terminates into a handle 80. The handle 80 has finger grips 90, and a thumb recess 110 (shown in FIG. 2). The handle 80, in one exemplary embodiment, has a hanger rib 150 having an aperture 100 by which the tool 10 can be hung. The distal end 30 terminates in a hook portion 50, and the hook portion terminating in a linear finger 60, the linear finger terminating at a tip 70. The linear finger 60 extends tangentially from the hook portion 50. In one exemplary embodiment, the linear finger 60 is disposed at an angle of about 40° with respect to the main shaft 130. In another embodiment the angle is between 30° and 50°. In one exemplary embodiment, the radius 190 of the hook portion 50 is about 1½ inches. In a further embodiment, the radius is between about 1 and 2 inches. The linear finger 70 may be about 1½ inches in length. A straight arm 40 may be secured to a distal portion 30, near the hook portion 50. The straight arm 40 may be disposed parallel to the main shaft 130. In one exemplary embodiment, as illustrated in FIG. 3, the straight arm 40 has an extension 200 that extends beyond the hook portion 50 by about 1 inch. This extension allows for poking of hot embers in a camp fire, without interference by the hook portion 50.

Figure 2:
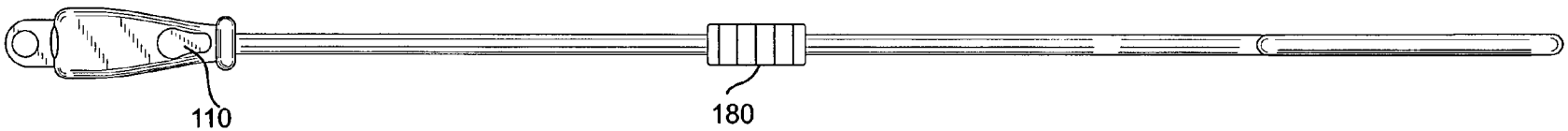
FIG. 2 is a top view of the present invention.
Figure 3:
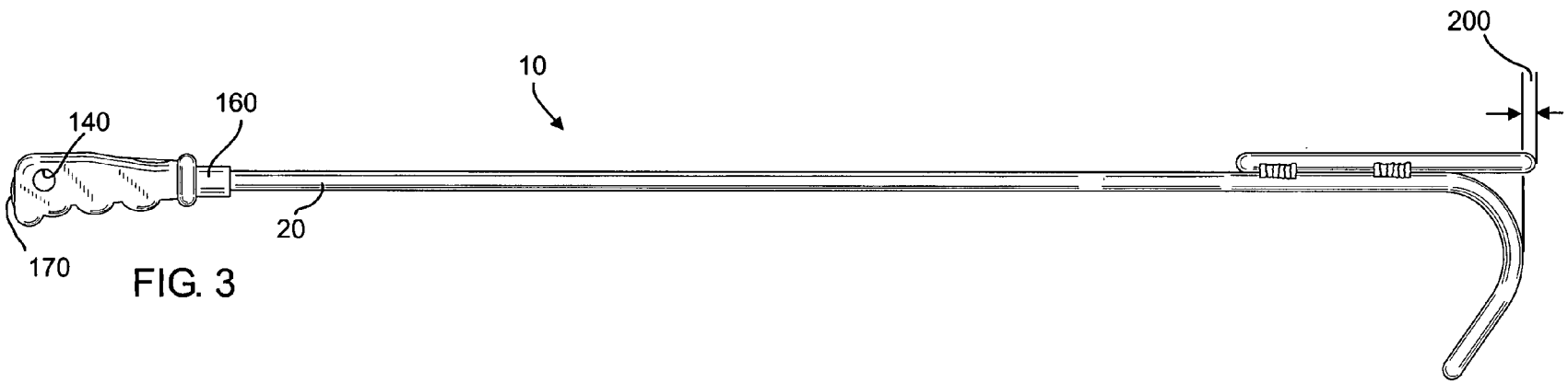
FIG. 3 is a side view of the present invention.
Figure 4:
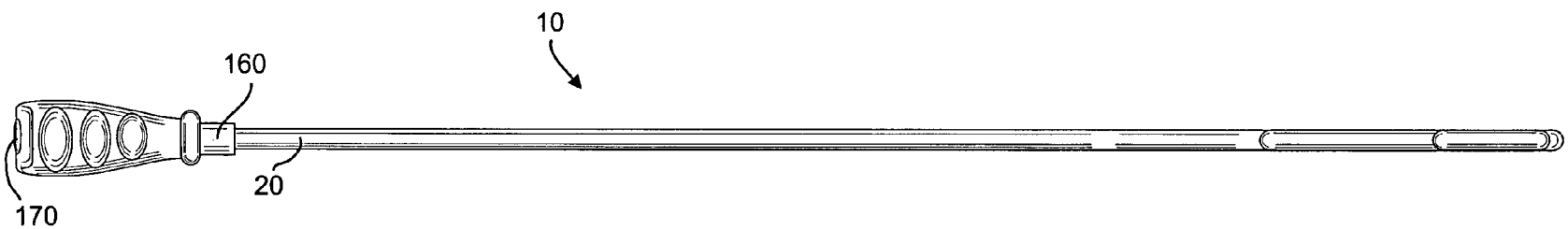
FIG. 4 is a bottom view of the present invention.

FIGS. 2 and 4 illustrate a different exemplary embodiment for the handle 80. This handle 80 has a handle aperture 140 disposed therethrough. In one exemplary embodiment the handle aperture 140 has a diameter of about 5/16 of an inch when used with a handle 80 having a diameter of about 1 inch.

As illustrated in FIGS. 1 and 2, in one exemplary embodiment the handle 80 is about 7¼ inches in length. The main shaft 130 may be about 2 feet in length when measured from the extending out of the handle 80 or a thermal barrier collar 160 to the hook portion 50. The main shaft 130 may be about 5/16 of an inch.

As illustrated in FIGS. 3 and 4, in another exemplary embodiment, the handle 80 does not contact the proximal end, but instead is secured to a thermal barrier collar 160 to prevent thermal stresses from occurring to the handle 80. The thermal barrier collar 160 is made of a different material than the handle 80. In one exemplary embodiment the thermal barrier collar 160 may be made from aluminum, or a material having similar thermal properties. The thermal barrier collar 160 may be able to conduct heat less than the handle 80; in which case the thermal barrier collar 160 will absorb heat, routing heat away from the handle, and also away from the main shaft 130. In even a further embodiment, handle 80 receives the proximal portion 20 of the main shaft 130, and the thermal barrier collar 160 surrounds the handle 80, whereby the thermal barrier collar 160 is axially disposed between the handle 80 and the main shaft 130.

As further illustrated in FIGS. 3 and 4, the handle may have a directional compass 170 disposed at its front end, i.e. away from the main shaft 130.

As illustrated in FIG. 2, an extension-retraction means 180 can be disposed on the main shaft 130 so the shaft can be lengthened or shortened. In one embodiment the extension-retraction means 180 may be disposed near the middle portion 120.

In one embodiment the main shaft 130, straight arm 40, hook portion 50, and linear finger 60 are a bright color, such as fluorescent orange. People associate objects with this color with a high degree of care, such as the fluorescent orange cones near a disabled semi-truck on the shoulder of a high speed interstate. This coloring serves the function of people being on alert when using the camp fire tool 10, as it may be hot. The color also serves the function of allowing people to easily find the tool 10, as it may be needed in a rush situation if the fire or embers are getting out of control. In another exemplary embodiment, the above elements 130, 40, 50, 60 comprise a reflective material so the tool 10 can be easily spotted by the reflection from the camp fire or other illumination. In one embodiment the main shaft 130, straight arm 40, hook portion 50, and linear finger 60 comprise a chrome color, or chrome plating.

It should be understood, of course, that the foregoing relates to exemplary embodiments of the invention and that modifications may be made without departing from the spirit and scope of the invention as set forth in the following claims.

I claim:

1. A camp fire tool, comprising:

a main shaft having a proximal end, a middle portion, and a distal end;

a handle disposed at said proximal end, said main shaft secured within said handle, said handle having finger grips, and an opposed thumb recess, said handle having a directional compass disposed at an end opposed from said main shaft, said handle further having a hanging aperture therethrough;

a thermal barrier collar disposed axially between said handle and said mainshaft, said thermal barrier collar substantially concentric with said handle;

a hook portion disposed at said distal end, said hook portion having a radius, and a further extending linear finger; and a straight arm disposed at said distal end, said straight end oriented substantially parallel to said main shaft.

2. The tool of claim 1, wherein said linear finger extends tangentially from said hook portion.

3. The tool of claim 1, wherein said linear finger is oriented at an angle of about 40° relative to said mainshaft.

4. The tool of claim 1, wherein said radius is about 1½ inches and said linear finger is about 1½ inches in length, and said hanging aperture is about 5/16 inches in diameter.

5. The tool of claim 1, wherein said linear finger is oriented at an angle of between about 30° and about 50° relative to the mainshaft.

6. The tool of claim 1, wherein said straight arm has an extension that extends beyond the hook portion.

7. The tool of claim 1, wherein at least one of said mainshaft, said straight arm, said hook portion, or said linear finger is made of a visually receptive fluorescent color.

8. The tool of claim 1, wherein at least one of said mainshaft, said straight arm, said hook portion, or said linear finger has a reflective portion thereon.

9. A camp fire tool, comprising:

a main shaft having a proximal end, a middle portion, and a distal end;

a thermal barrier collar disposed at said proximal end, said main shaft secured within said thermal barrier collar, said thermal barrier collar substantially concentric with a handle;

said handle extending away from said mainshaft, said handle having finger grips, and an opposed thumb recess, said handle having a directional compass disposed at an end opposed from said main shaft, said handle further having a hanging aperture therethrough;

a hook portion disposed at said distal end, said hook portion having a radius, and a further extending linear finger; and a straight arm disposed at said distal end, said straight end oriented substantially parallel to said main shaft.

10. The tool of claim 9, wherein said linear finger is oriented at an angle of between about 30° and about 50° relative to the mainshaft, and said straight arm has an extension that extends beyond the hook portion by about 1 inch.

11. The tool of claim 9, wherein at least one of said mainshaft, said straight arm, said hook portion, or said linear finger is made of a visually receptive fluorescent color.

12. The tool of claim 9, wherein at least one of said mainshaft, said straight arm, said hook portion, or said linear finger comprises a chrome color.

* * * * *